US005659226A

United States Patent [19]

Shigeta

[11] Patent Number: 5,659,226

[45] Date of Patent: Aug. 19, 1997

[54] HIGH PRECISION PLASMA DISPLAY APPARATUS

[75] Inventor: Tetsuya Shigeta, Koufu, Japan

[73] Assignee: Pioneer Electronic Corporation, Tokyo, Japan

[21] Appl. No.: 423,949

[22] Filed: Apr. 19, 1995

[30] Foreign Application Priority Data

Apr. 20, 1994 [JP] Japan ..... 6-081924

[51] Int. Cl.[6] ..... H01J 17/49; G09G 3/10

[52] U.S. Cl. ..... 313/491; 313/584; 315/169.4; 345/37

[58] Field of Search ..... 313/491, 484, 313/493, 495, 496, 497, 500, 503, 504, 584–85; 345/74, 77, 80, 55, 37; 315/169.4

[56] References Cited

U.S. PATENT DOCUMENTS 5,107,182 4/1992 Sano ..... 313/493

FOREIGN PATENT DOCUMENTS 5-205642 8/1993 Japan .

*Primary Examiner*—Sandra L. O'Shea
*Assistant Examiner*—Mack Haynes
*Attorney, Agent, or Firm*—Keck, Mahin & Cate

[57] ABSTRACT

A plasma display apparatus is adapted to the increase in fineness of the display. Column electrodes extend in parallel in the vertical direction. Light emission layers are made of fluorescent material films of R, G, and B and extend in parallel along the column electrodes and in which light emission colors of the adjacent layers are different. Row electrodes Xi extend in the horizontal direction and form pixel cells PU at positions near the intersecting portions with the column electrodes. Among the pixel cells, two cells which are neighboring in the horizontal direction are arranged so as to deviate from each other in the vertical direction.

6 Claims, 13 Drawing Sheets

HIGH PRECISION PLASMA DISPLAY APPARATUS

BACKGROUND OF THE INVENTION

1. Field of the Invention

The present invention relates to a plasma display apparatus (hereinafter, referred to as a PDP) and its driving apparatus.

2. Related Background Art

In recent years, a method of exciting and emitting a fluorescent material by the irradiation of ultraviolet rays generated in association with a discharge is used for realizing a color display by a PDP. Practically, fluorescent materials of three different colors such as R (red), G (green), and B (blue) are appropriately combined, thereby performing a display of color. Further, in case of a matrix-type display, namely, in case of displaying characters or figures by combinations of pixels, at least three unit light emitting regions corresponding to the above-mentioned three colors are formed for each pixel. As such a color display PDP, for example, an apparatus is disclosed in Japanese Patent Kokai No. 5-205642.

The above apparatus includes: a plurality of row electrode pairs each comprising a pair of row electrodes adjacently arranged in parallel in the horizontal direction on one of substrates; a plurality of address electrodes arranged in the vertical direction in order to selectively allow a unit light emitting region to emit light; and fluorescent material films of three primary colors of R, G, and B which are formed on a substrate serving as a display surface so as to face the row electrode pairs via a discharge space and are excited by ultraviolet rays generated by a discharge between the row electrode pairs.

In order to improve a resolution in the vertical direction of the PDP, it is necessary to form one pixel in a small size because the number of row electrodes in the vertical direction has to be increased by increasing the number of pixels in the vertical direction. When the dimensions of one pixel are reduced, the dimensions of the row electrode are also reduced. It is, therefore, difficult to precisely manufacture the row electrodes in excess of a patterning precision and a width of row electrode is so narrow that a disconnection of the electrode easily occurs.

SUMMARY OF THE INVENTION

In consideration of the above problems, an object of the invention is to provide a PDP corresponding to a high fineness.

A plasma display apparatus of the present invention includes: a plurality of column electrodes which extend in parallel in the vertical direction; light emission layers which are made of fluorescent material films of R (red), G (green), and B (blue) and which extend in parallel along the column electrodes and in which light emission colors of the adjacent layers are different; and a plurality of row electrodes which extend in the horizontal direction perpendicular to the column electrodes and which form unit light emitting regions at positions near the intersecting portions with the column electrodes, wherein among the unit light emitting regions, two regions which are neighboring in the horizontal direction are arranged so as to deviate from each other in the vertical direction.

According to the plasma display apparatus of the invention, among the unit light emitting regions, two regions which are neighboring in the horizontal direction are arranged so as to deviate from each other in the vertical direction perpendicular to the horizontal direction.

DETAILED DESCRIPTION OF THE EMBODIMENTS

Before entering into the explanation of the embodiments of the invention, an example of conventional plasma display panels will be described with reference to the drawings.

Figure 1:
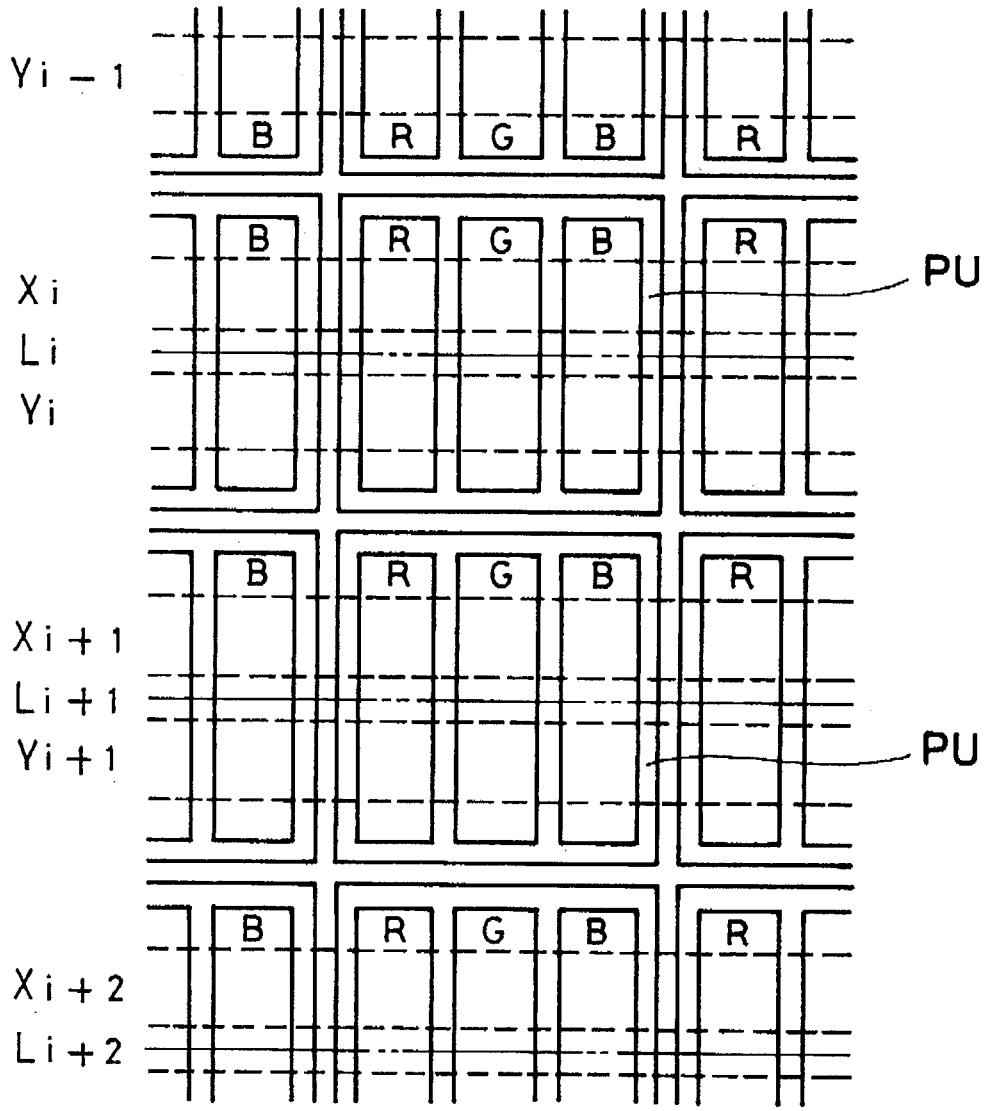
FIG. 1 (PRIOR ART)
FIG. 1 is a plan view schematically showing an arrangement relation between pixels and row electrodes of a conventional PDP.

The aforementioned apparatus disclosed in Japanese Patent Kokai No. 5-205642 includes: a plurality of row electrode pairs each comprising a pair of row electrodes adjacently arranged in parallel in the horizontal direction on one of substrates; a plurality of address electrodes arranged in the vertical direction in order to selectively allow a unit light emitting region to emit a light; and fluorescent material films of three primary colors of R, G, and B which are formed on a substrate serving as a display surface so as to face the row electrode pairs via a discharge space and are excited by ultraviolet rays generated by a discharge between the row electrode pairs. FIG. 1 is a plan view schematically showing the arrangement relation between row electrode pairs {Xi, Yi} (i=1, 2, . . . , n) of the above-mentioned apparatus and the fluorescent material films. In FIG. 1, three unit light emitting regions of different light emission colors corresponding to the three primary colors are formed as one pixel PU and each pixel PU is orderly arranged in both of the horizontal and vertical directions, thereby constituting the PDP.

Figure 2:
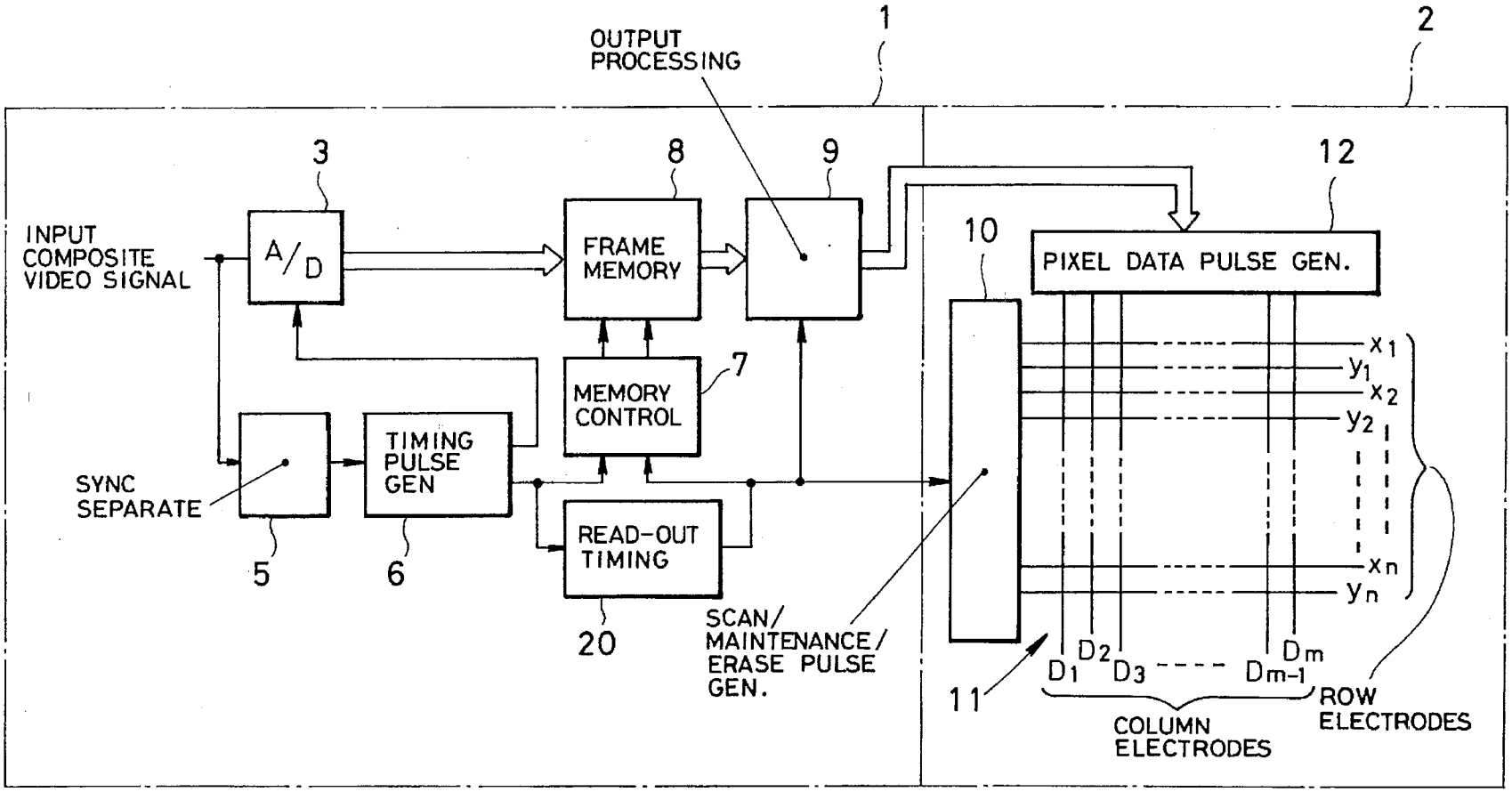
FIG. 2 (PRIOR ART)
FIG. 2 is a structural diagram showing a driving apparatus of the PDP in FIG. 1.

The driving apparatus of the above-mentioned PDP will now be schematically described with reference to FIG. 2.

The driving apparatus comprises a signal processing section 1 for processing what is called a composite video signal as an input signal and a display section 2 for displaying a two-dimensional picture plane by receiving a drive signal from the signal processing section 1.

In the signal processing section 1, an A/D converter 3 converts an input composite video signal to digital pixel data synchronously with a timing pulse supplied from a timing pulse generating circuit 6. The digital pixel data is supplied to a frame memory 8. A sync separating circuit 5 extracts horizontal and vertical sync signals from the input composite video signal and supplies to the timing pulse generating circuit 6. The timing pulse generating circuit 6 generates various timing pulses based on those horizontal and vertical sync signals. A memory control circuit 7 supplies a write signal and a read signal synchronized with the timing pulse supplied from the timing pulse generating circuit 6 to the frame memory 8. The frame memory 8 sequentially fetches the pixel data supplied from the A/D converter 3 in accordance with the write signal. The frame memory 8 sequentially reads out the pixel data stored in the frame memory 8 in accordance with the read signal and supplies to an output processing circuit 9 at the next stage.

The output processing circuit 9 forms first to eighth mode pixel data corresponding to the luminance gradations every field of the supplied pixel data and supplies those data to a pixel data pulse generating circuit 12 synchronously with the timing pulse from the timing pulse generating circuit 6.

Figure 3:
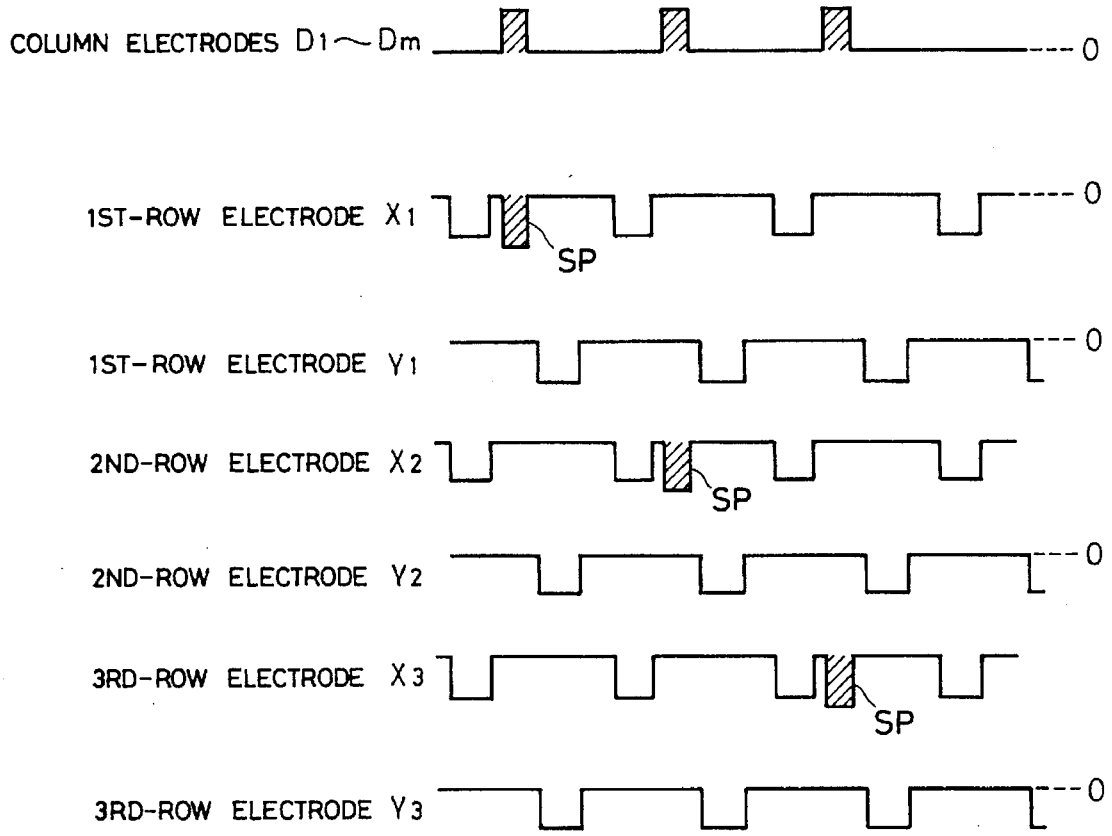
FIG. 3 (PRIOR ART)
FIG. 3 is a diagram showing operation waveforms by the driving apparatus of the PDP shown in FIG. 2.

For example, as shown in FIG. 3, in response to the timing pulse from the timing pulse generating circuit 6, a scan/maintenance/erase pulse generating circuit 10 generates a scan pulse SP for starting a discharge light emission, a maintenance pulse for maintaining a discharge state, and an erase pulse for stopping the discharge light emission, respectively, and supplies to row electrodes Y1, Y2, Y3, . . . , Yn−1, and Yn and X1, X2, X3, . . . , Xn−1, and Xn of a PDP (plasma display apparatus) 11. The scan pulse SP is applied to only one, for instance, X1 to Xn of the row electrode groups constituting the above described electrodes pair. The pixel data of each pixel in the PDP is sequentially scanned in the vertical direction and scan lines L1, L2, L3, . . . , Ln−1, and Ln are formed.

The pixel data pulse generating circuit 12 generates a pixel data pulse having a voltage value corresponding to the logic "1" or "0" of the pixel data of one field supplied from the output processing circuit 9 and divides the pixel data pulse every row. The pixel data pulse divided every row is applied to column electrodes D1, D2, D3, D4, . . . , Dm−1, and Dm in a time sharing fashion.

In the above construction, in order to improve the resolution in the vertical direction of the PDP, it is necessary to form each pixel in a small size because the number of row electrodes in the vertical direction has to be increased by increasing the number of pixels in the vertical direction. When the dimensions of one pixel are reduced, the dimensions of the row electrode are also to be reduced. It is, therefore, difficult to manufacture the row electrodes more precisely than a patterning precision as aforementioned and the width of row electrode is so narrow that a disconnection of the electrode easily occurs.

An embodiment of the invention will now be described hereinbelow with reference to the drawings.

Figure 4:
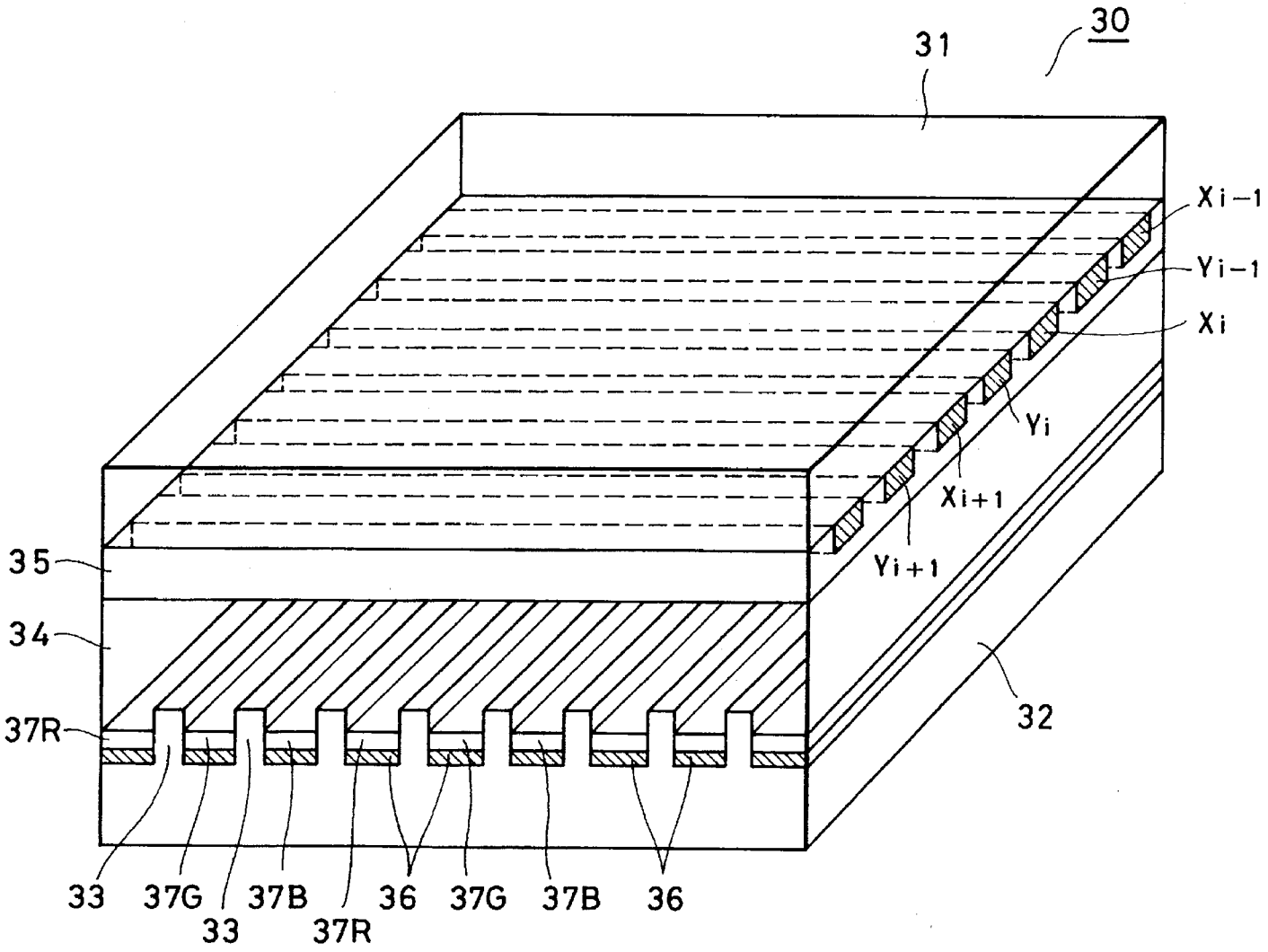
FIG. 4 is a perspective view showing a construction of a PDP according to the first embodiment of the invention.
Figure 5:
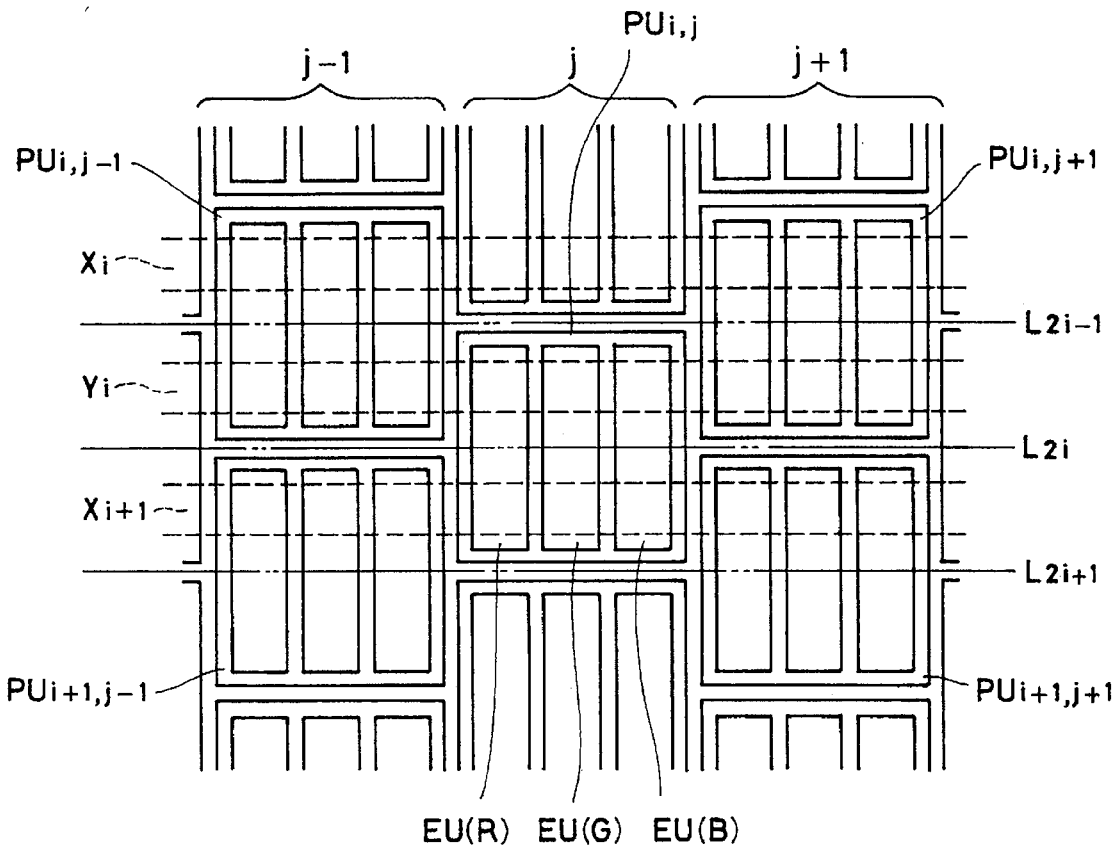
FIG. 5 is a plan view for explaining the relation between each pixel cell and row electrodes in the PDP in FIG. 4.

In FIGS. 4 and 5, reference numeral 30 denotes a plurality of pixel cells of a PDP of an A/C surface discharge type using a three electrode construction. In the pixel cells 30, for example, a discharge space 34 is partitioned by a front substrate 31 and a rear substrate 32 which are made of transparent glass and face each other in parallel via a gap of 100 to 200 μm and by partitions 33 and 33 formed so as to extend in the vertical direction of the rear substrate 32.

The front substrate 31 is a display surface. In the front substrate 31, a plurality of row electrodes Xi and Yi (i=1, 2, . . . , n) are formed on the plane which faces the rear substrate 32 by an evaporation deposition of, for example, ITO, SnO (tin oxide), or the like so as to extend in parallel to each other in the horizontal direction with a film thickness of about a few hundreds nanometers. Two of the adjacent row electrodes Xi and Yi constitute a pair of row electrodes. Further, a dielectric layer 35 having a film thickness of about 10 μm is formed so as to cover those row electrodes. An MgO layer (not shown) made of MgO (magnesium oxide) having a thickness of about a few hundreds nm is laminated and formed on the dielectric layer 35.

On the other hand, in order to hold a gap between the front substrate 31 and the rear substrate 32, the partitions 33 are formed on the rear substrate 32 in parallel at intervals of, for example, 300 μm by using, for instance, a thick film printing technique so that a width is set to 50 μm and the partitions 33 in the longitudinal direction intersect the row electrodes Xi and Yi. Further, column electrodes 36 made of, for example, aluminum (Al) or aluminum alloy having a thickness of about 100 nm are formed so as to face simultaneously the row electrodes Xi and Yi and extend in the vertical direction on the rear substrate 32 between the adjacent partitions 33. Since the column electrodes 36 are made of a metal having a high reflectance such as Al or Al alloy, they have a reflectance of 80% or more in a wavelength band of 380 to 650 nm. The column electrodes are sequentially partitioned in the horizontal direction as a column electrode group Aj in which the three column electrodes 36, 36, and 36 which are sequentially arranged in the horizontal direction in order to form one pixel cell form a unit of electrodes. The suffix of the reference character is sequentially increased every column electrode group Aj. The column electrode 36 can be made of not only Al or Al alloy but also of an appropriate metal or alloy having a high reflectance such as Cu, Au, or the like.

Fluorescent material films 37R, 37G, and 37B corresponding to R, G, and B are formed as light emitting layers having a thickness of, for instance, 10 to 30 μm so as to cover the column electrodes 36 in accordance with the order of, for example, R, G, and B from the left side to the right side. Compositions and dimensions of those fluorescent material films 37R, 37G, and 37B are selected so that the mixed color of the three colors becomes white color when the films are simultaneously excited under the same conditions.

As mentioned above, the front substrate 31 and rear substrate 32 on which the electrodes Xi, Yi and 36 are formed are sealed and the discharge space 34 is exhausted and further, the moisture on the surface of the MgO layer is eliminated by baking. Subsequently, for example, Ne Xe gas or He Xe gas as a rare gas is injected and sealed in the discharge space 34.

Discharge spaces EU (R), EU (G), and EU (B) which can respectively perform a color display are formed by the discharge spaces of three colors having different light emission colors which are sequentially arranged in the horizontal direction. One pixel cell PUi,j of the PDP in which those three discharge spaces EU (R), EU (G), and EU (B) serve as one unit is formed as a unit light emitting region. That is, one pixel cell comprises the three discharge spaces EU (R), EU (G), and EU (B). In each discharge space, the discharge is started, maintained, and erased by three electrodes of the row electrodes comprising two row electrodes Xi and Yi and the column electrode which intersects those row electrodes.

Figure 6:
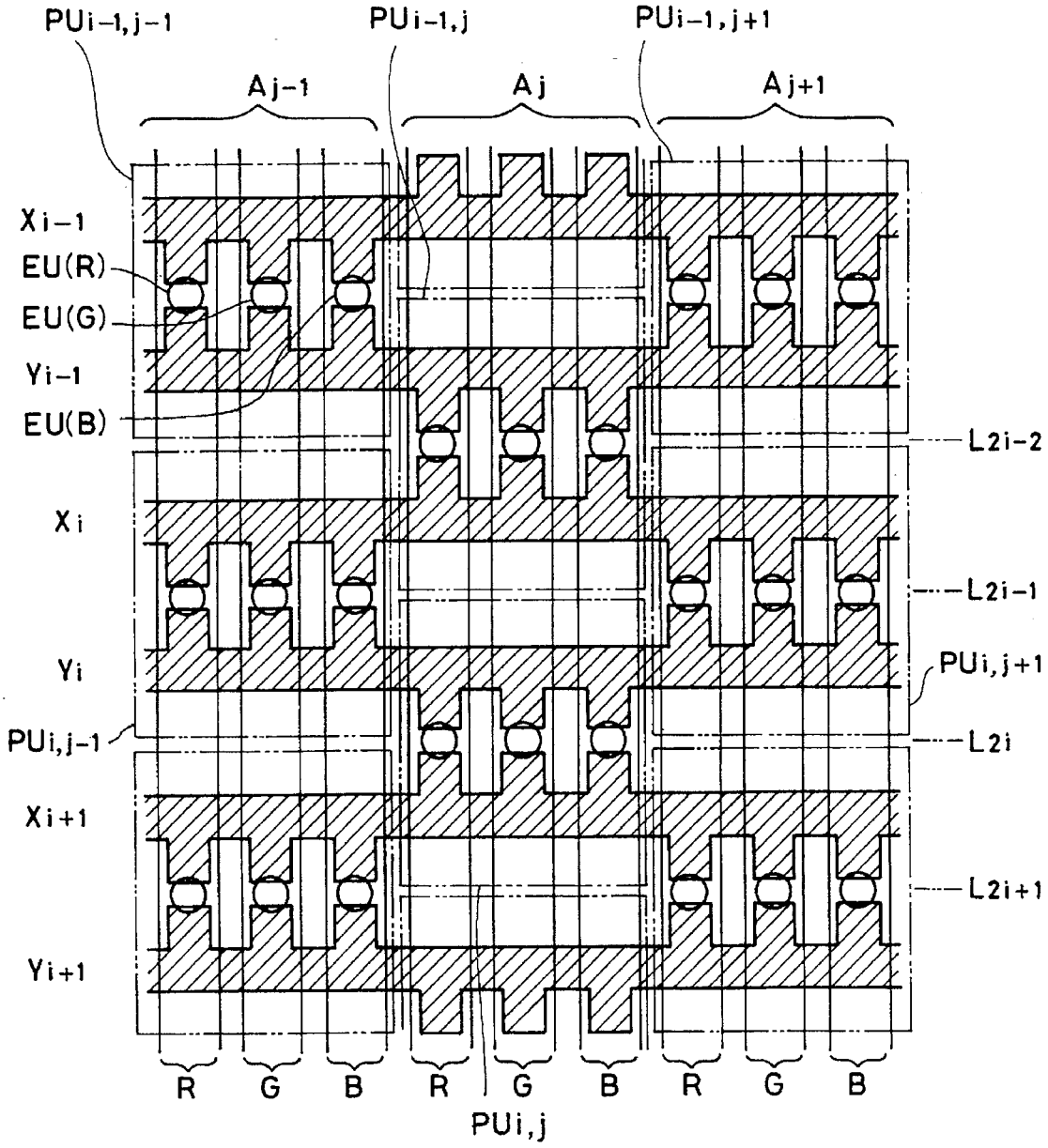
FIG. 6 is a plan view for explaining the relation between each pixel cell and light emitting regions in the PDP in FIG. 4.

The arrangement relation between one pixel cell PU and the pixel cell PU which adjoins such a pixel cell PU will now be described with reference to FIGS. 5 and 6. In FIGS. 5 and 6, when observing one (PUi,j) of the pixel cells, one pair of row electrodes Xi and Yi are formed in the following manner. The row electrode Yi which is located upward in the figure among the row electrodes in the pixel cell PUi,j extends in the horizontal direction and becomes the row electrode Yi which is located downward among the row electrodes in pixel cells PUi,j−1 and PUi,j+1 which are located upward (obliquely upward in FIG. 5) in the pixel cells which are neighboring in both of the horizontal and vertical directions. A row electrode Xi+1 which is located downward among the row electrodes in the pixel cell PUi,j extends in the horizontal direction and becomes the row electrode Xi+1 which is located upward among the row electrodes in pixel cells PUi+1,j−1 and PUi+1,j+1 which are located downward (obliquely downward in FIG. 5) in the pixel cells which are neighboring in both of the horizontal and vertical directions. Each of the pair of row electrodes Xi and Yi extending in the horizontal direction of the PDP becomes either one of the row electrodes locating downward and upward in the pixel cells PU which are neighboring in the horizontal direction and extends in the horizontal direction of the PDP while it alternately becomes the row electrode locating downward or the row electrode locating upward each time it crosses the pixel cells PU which are neighboring in the horizontal direction.

Therefore, in writing pixel data into each pixel cell PU, as shown in FIG. 5, for instance, when the scan pulse SP is applied to the row electrode Yi, the pixel data is written into the pixel cells PUi,j−1 and PUi,J+1 by the scan pulse SP. When the scan pulse SP is applied to the row electrode Xi+1 which adjoins the row electrode Yi, the pixel data is written into the pixel cell PUi,j by the scan pulse SP. As mentioned above, in the PDP of the embodiment, the scan pulse is sequentially applied to the row electrodes Xi, Yi, Xi+1, and Yi+1. That is, since the row electrodes Xi and Yi correspond to scan lines L2i−1 and L2i, the total number of scan lines (L) of the PDP is twice as large as that of the conventional PDP shown in FIG. 1, so that the resolution in the vertical direction is improved.

As mentioned above, one of the pixel cells PU adjoins two pixel cells per one side in the horizontal direction. The pixels adjacent to such a pixel cell on one side in the horizontal direction are arranged so as to deviate from the previous pixel cell in the vertical direction.

The driving apparatus of the above-mentioned PDP will now be described with reference to FIG. 7.

Figure 7:
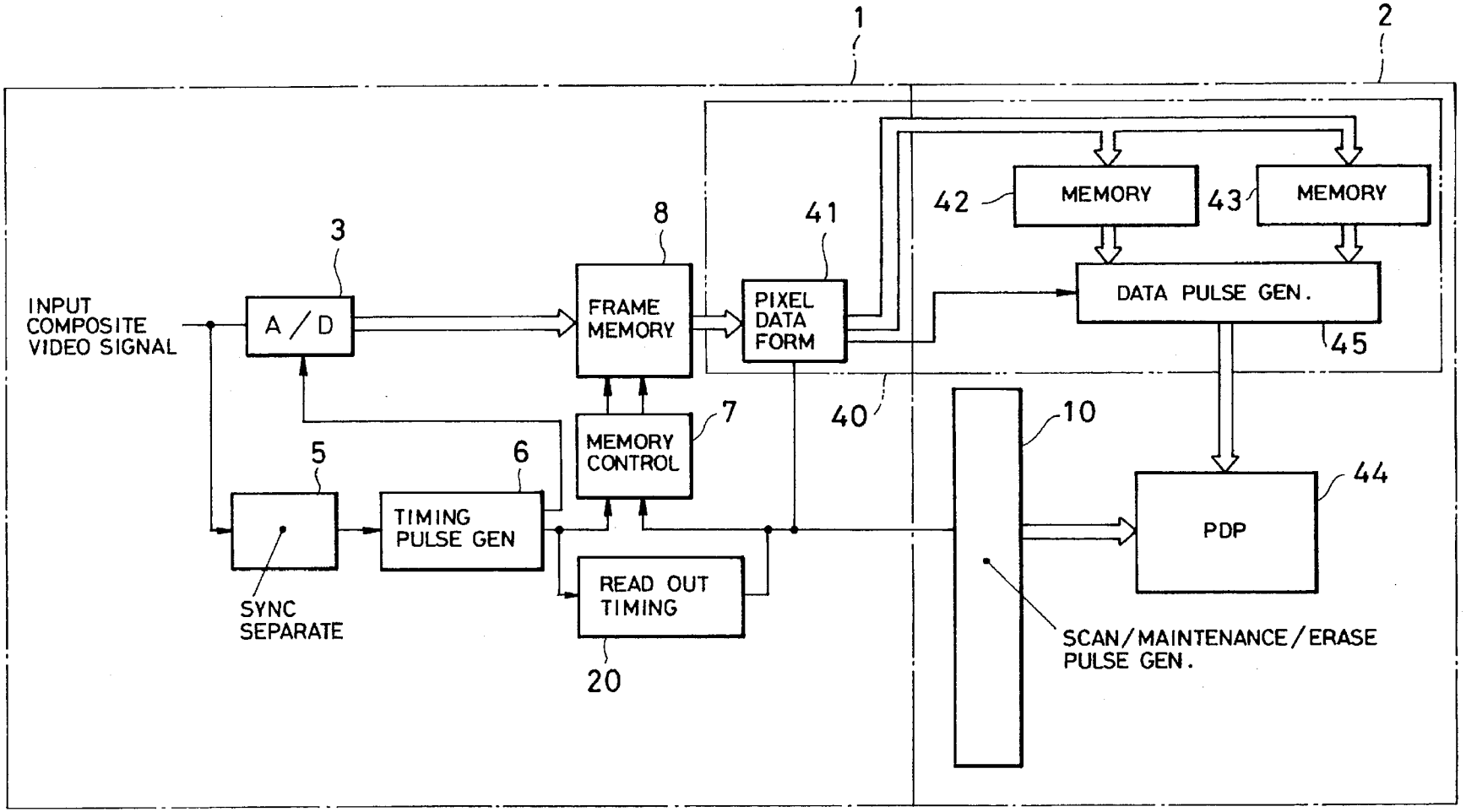
FIG. 7 is a structural diagram showing a driving apparatus of the PDP according to the invention.

In FIG. 7, the above driving apparatus comprises: the signal processing section 1 for processing what is called a composite video signal as an input signal in which a resolution in the vertical direction is set to a double density as compared with that of the conventional video signal such as a high precision television signal; and the display section 2 for displaying a two-dimensional picture plane by receiving the drive signal from the signal processing section 1.

In the signal processing section 1, the A/D converter 3 converts an input composite video signal into digital pixel data synchronously with a timing pulse supplied from the timing pulse generating circuit 6 and supplies to the frame memory 8. The sync separating circuit 5 extracts horizontal and vertical sync signals from such an input composite video signal and supplies to the timing pulse generating circuit 6. The timing pulse generating circuit 6 generates various timing pulses based on those horizontal and vertical sync signals. The memory control circuit 7 supplies a write signal and a read signal which are synchronized with the timing pulses supplied from the timing pulse generating circuit 6 to the frame memory 8. The frame memory 8 sequentially fetches the pixel data supplied from the A/D converter 3 in accordance with the write signal. The frame memory 8 also sequentially reads out the pixel data stored in the frame memory 8 in accordance with the read signal and supplies to a pixel data distribution control circuit 40 as pixel data distribution control means at the next stage.

The pixel data distribution control circuit 40 has: a pixel data forming circuit 41; two memories 42 and 43 each of which is connected to the pixel data forming circuit 41; and a data relay and data pulse generating circuit 45 which is connected to the memories 42 and 43 and which supplies the pixel data to a PDP 44.

Figure 8:
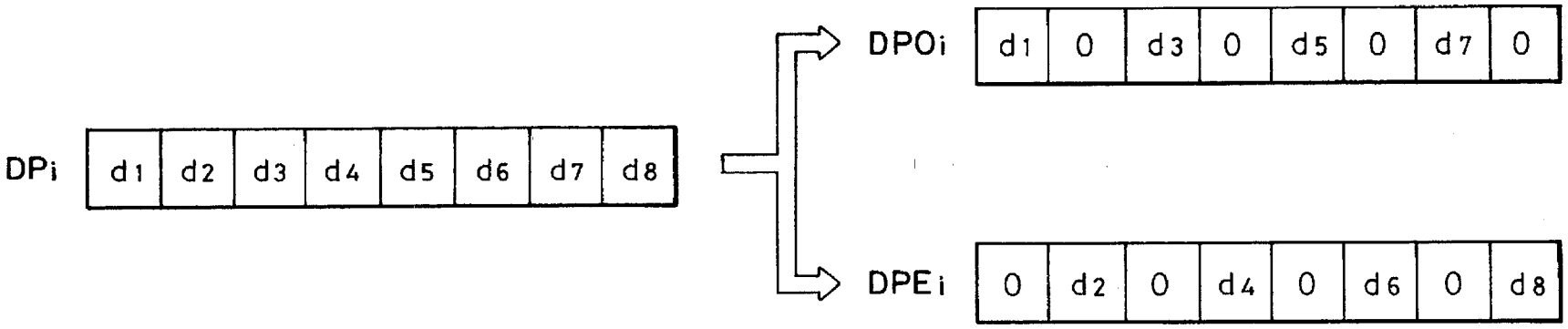
FIG. 8 is a schematic diagram for explaining the formation of odd-number column pixel data and even-number column pixel data which are used in the driving apparatus of the PDP shown in FIG. 7.

As shown in FIG. 8, the pixel data forming circuit 41 forms, for example, first to eighth mode pixel data DPi corresponding to the luminance gradations every field of the supplied pixel data. On the basis of the pixel data DPi, the pixel data forming circuit 41 forms: odd-number column pixel data DPOi which has only data elements corresponding to a group of odd-number column electrodes and in which the data elements corresponding to a group of even-number column electrodes are forcibly set to "0"; and even-number column pixel data DPEi which has only data elements corresponding to a group of even number column electrodes and in which the data elements corresponding to a group of odd-number column electrodes are forcibly set to "0". The formed odd-number column pixel data DPOi and even-number column pixel data DPEi are stored into the corresponding memories 42 and 43, respectively.

The pixel data forming circuit 41 alternately generates an odd-number timing pulse and an even-number timing pulse to the data relay and data pulse generating circuit 45 synchronously with the timing pulses from the timing pulse generating circuit 6. Therefore, the data relay and data pulse generating circuit 45 reads out one of the odd-number and even-number column pixel data DPOi and DPEi corresponding to the odd-number and even-number timing pulse from the memory, generates the pixel data pulse having a voltage value corresponding to the logic "1" or "0" of the pixel data in the memory on the basis of the read data, divides it every row, and supplies the pixel data pulses divided every row to column electrode pairs A1, A2, A3, A4, . . . , Am−1, and Am of the PDP 44 in a time sharing fashion.

The scan/maintenance/erase pulse generating circuit 10 generates the scan pulse SP for starting the discharge light emission, the maintenance pulse for maintaining the discharge state, and the erase pulse for stopping the discharge light emission, respectively, in response to the timing pulse from the timing pulse generating circuit 6 and supplies those pulses to the row electrodes {X1, Y1}, . . . , and {Xn, Yn} of the PDP 44.

Figure 9:
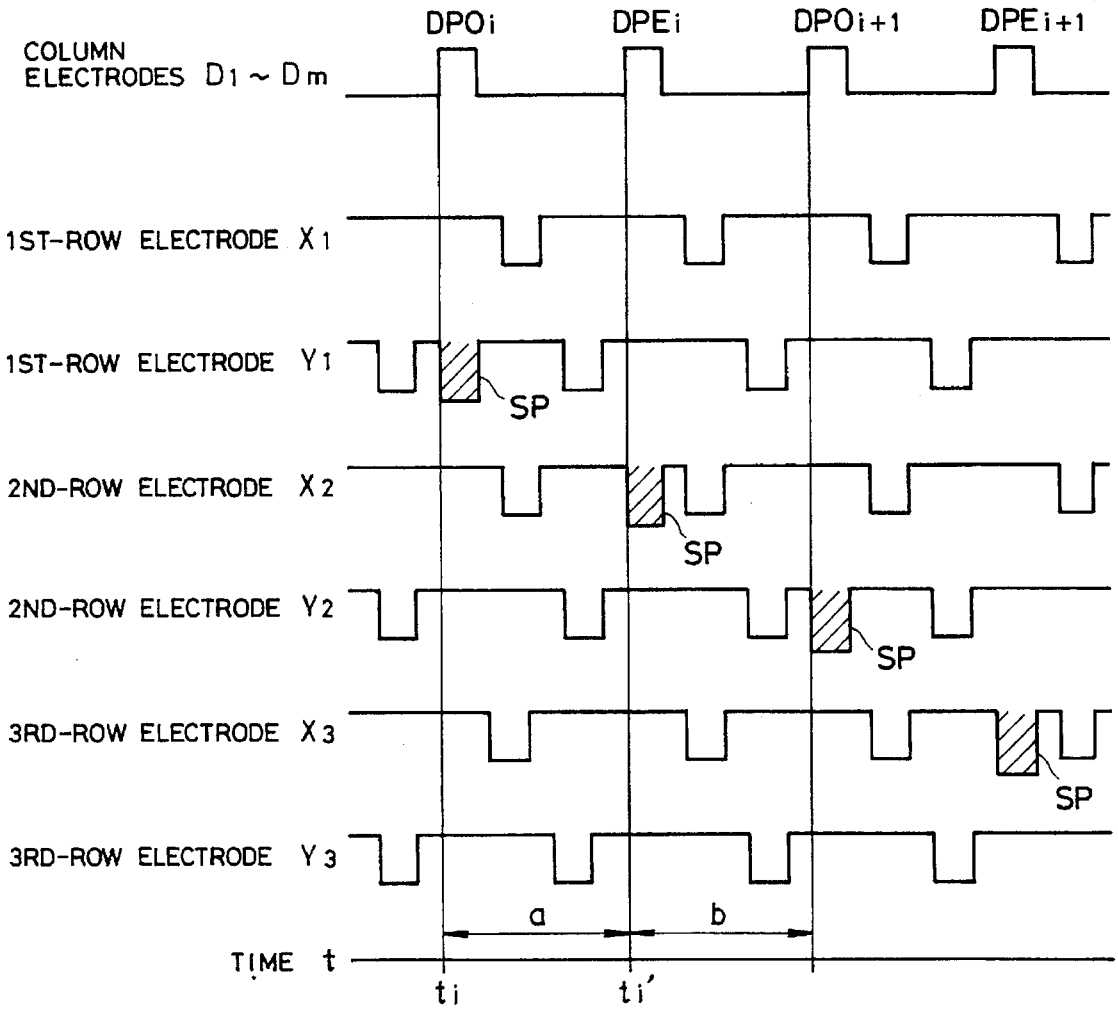
FIG. 9 is a diagram showing operation waveforms by the driving apparatus of the PDP shown in FIG. 7.

FIG. 9 is a diagram showing the driving operation timings by the above-mentioned driving apparatus.

The driving operation will now be described hereinbelow by attaching an importance to the pixel cell arranged in the first row.

In the diagram, when the odd-number timing pulse is generated synchronously with the timing pulse from the timing pulse generating circuit 6 at a time point ti in an interval (a), the scan pulse SP and the pixel data pulse DPOi are simultaneously supplied to the row electrode Y1. In this instance, since a potential difference between the scan pulse SP and the pixel data pulse DPOi exceeds the discharge start voltage in the pixel cell in which the row electrode Y1 applied with the scan pulse SP is located downward, a discharge light emission occurs. On the other hand, in the pixel cell in which the row electrode Y1 applied with the scan pulse SP is located upward, the potential by the pixel data pulse DPOi is equal to "0". Since a potential difference between the scan pulse SP and the pixel data pulse DPOi is equal to or lower than the discharge start voltage, no discharge light emission occurs. That is, among the pixel cells in which the row electrode Y1 extends, the light emission is started every other pixel cell in the horizontal direction.

When the even-number timing pulse is generated synchronously with the timing pulse from the timing pulse generating circuit 6 at a time point ti' in an interval (b) after the elapse of a predetermined time after the odd-number timing pulse had been generated, the scan pulse SP and the pixel data pulse DPEi are simultaneously supplied to the row electrode X2. In this instance, since the potential difference between the scan pulse SP and the pixel data pulse DPEi exceeds the discharge start voltage in the pixel cell in which the row electrode X2 applied with the scan pulse SP is located downward, the discharge light emission occurs. On the other hand, in the pixel cell in which the row electrode X2 applied with the scan pulse SP is located upward, the potential by thepixel data pulse DPEi is equal to "0". Since the potential difference between the scan pulse SP and the pixel data pulse DPEi is equal to or lower than the discharge start voltage, no discharge light emission occurs. That is, among the pixel cells in which the row electrode X2 extends, the light emission is started every other pixel cell in the horizontal direction.

Therefore, by sequentially supplying the scan pulse SP to the row electrodes {X1, Y1}, {X2, Y2}, . . . , and {Xn, Yn} arranged in the vertical direction in accordance with the odd-number and even-number timing pulses which are alternately generated, information corresponding to the pixel data is sequentially written to the pixel cell of the PDP.

The second embodiment the invention will now be described with reference to FIGS. 10 and 11.

Figure 10:
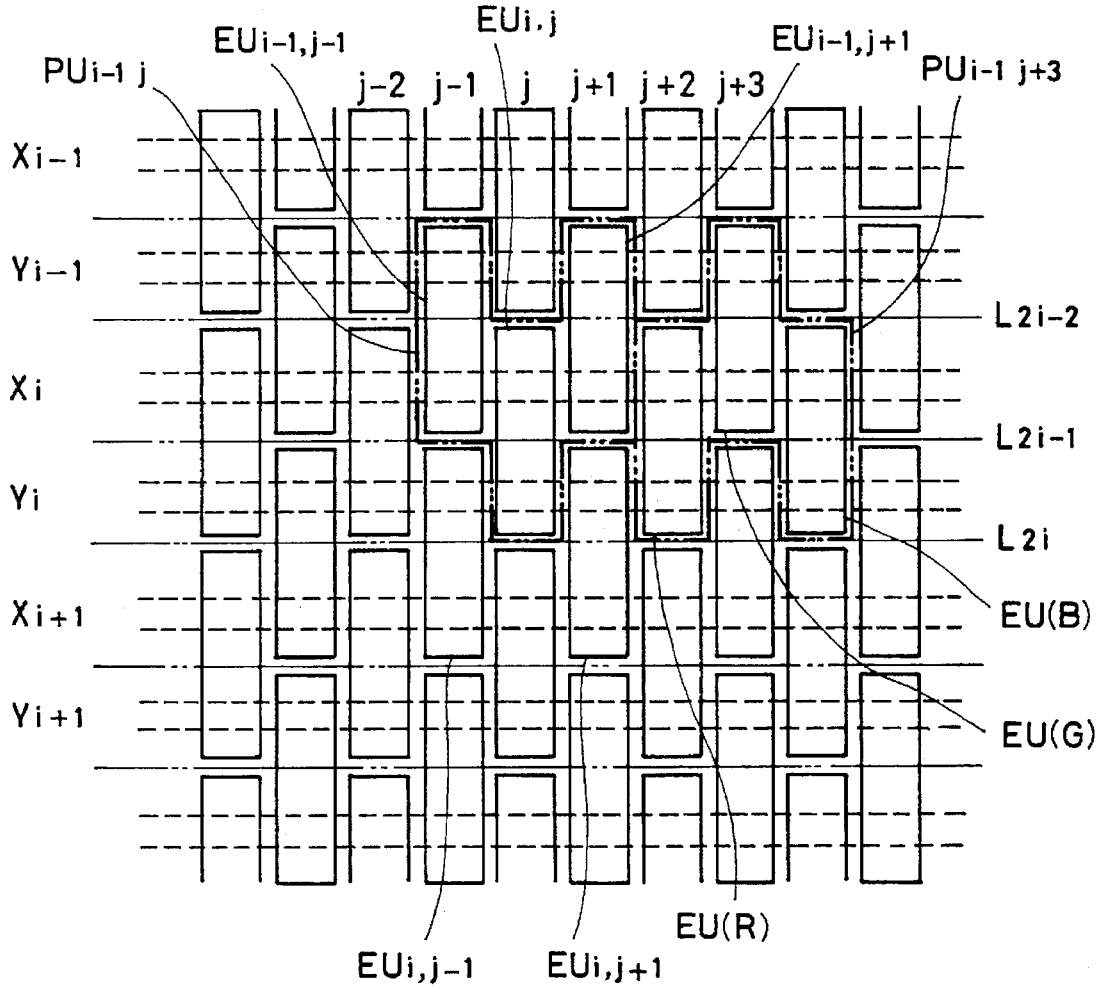
FIG. 10 is a plan view for explaining the relation between each pixel cell and row electrodes in a PDP according to the second embodiment of the invention.
Figure 11:
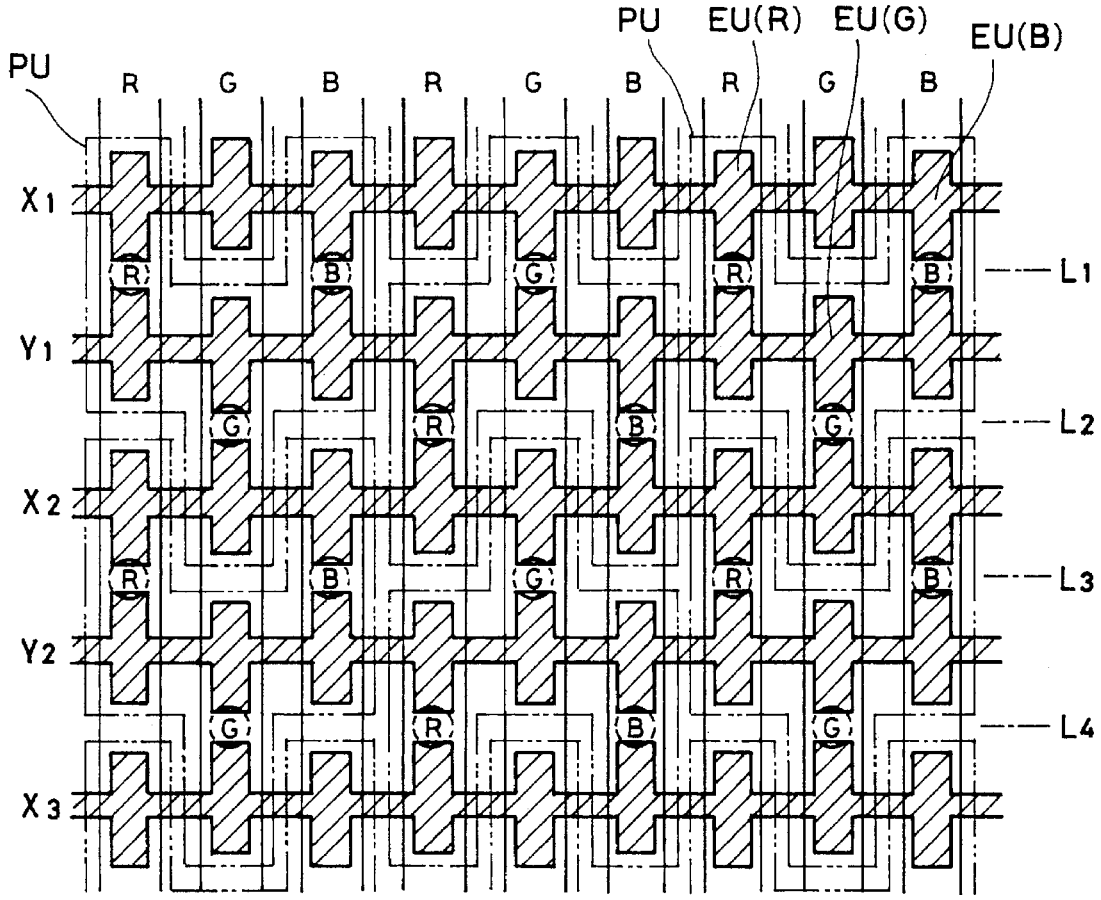
FIG. 11 is a plan view for explaining the relation between each pixel cell and light emitting regions in the PDP shown in FIG. 10.

In FIGS. 10 and 11, the pixel cells of the PDP of the A/C surface discharge type are constructed in a manner almost similar to those in FIGS. 4 and 5 and the same component elements as those in FIGS. 4 and 5 are designated by the same reference numerals and their descriptions are omitted here.

In FIG. 10, the row electrodes Xi and Yi are formed by an evaporation deposition of, for example, ITO, SnO (tin oxide), or the like so as to have a film thickness of about a few hundreds nm and to extend in parallel in the horizontal direction. Two of the adjacent row electrodes Xi and Yi construct a pair of row electrodes. On the other hand, the column electrodes (not shown) are formed on a rear substrate (not shown) in a manner similar to FIGS. 4 and 5. The discharge spaces EU are formed around the region in which the row electrodes Xi and Yi which construct the pair and the column electrodes intersect as a center and the discharge spaces EU function as a unit light emitting region.

The arrangement relation between one unit light emitting region EU and the unit light emitting region EU which adjoins such a unit light emitting region EU will now be described with reference to FIG. 10. In FIG. 10, when an attention is paid to one (EUi,j) of the unit light emitting regions, each pair of row electrodes Xi and Yi are formed in the following manner. The row electrode Xi locating upward among the row electrodes in the unit light emitting region EUi,j extends in the horizontal direction and becomes the row electrode Xi locating downward among the row electrodes in unit light emitting regions EUi−1,j−1 and EUi−1, j+1 which are located upward (obliquely upward in FIG. 10) in the unit light emitting regions which are neighboring in both of the horizontal and vertical directions. The row electrode Yi locating downward among the row electrodes in the unit light emitting region EUi,j extends in the horizontal direction and becomes the row electrode Yi locating upward among the row electrodes in unit light emitting regions EUi,j−1 and EUi,j+1 which are located downward (obliquely downward in FIG. 10) in the unit light emitting regions which are neighboring in both of the horizontal and vertical directions. As mentioned above, one of the row electrodes Xi and Yi extending in the horizontal direction of the PDP becomes either one of the pair of row electrodes in the unit light emitting regions EU which are neighboring in the horizontal direction and extends in the horizontal direction of the PDP while it alternately becomes the row electrode locating upward or the row electrode locating downward in each unit light emitting region each time it crosses the unit light emitting regions which are neighboring in the horizontal direction.

In the PDP, since the fluorescent material layers of three colors of R, G, and B are formed so that the light emission colors of the adjacent layers are different along the column electrodes which are sequentially arranged in the horizontal direction, one pixel cell PU of the PDP is formed by setting three unit light emitting regions EU(R), EU(G), and EU(B) of different light emission colors which are neighboring to one unit as shown in the diagram.

Therefore, the pixel data is actually written into each pixel cell as described hereinbelow. Namely, as shown in FIG. 10, for instance, when the scan pulse SP is supplied to the row electrode Yi−1, the pixel data is written into the unit light emitting regions EUi−1,j−1 and EUi−1,j+1 in the pixel cell PUi−1,j by the scan pulse. When the scan pulse SP is supplied to the row electrode Xi which adjoins the row electrode Yi−1, the pixel data is written into the unit light emitting region EUi,j by the scan pulse SP.

As mentioned above, since the writing operation is executed by sequentially applying the scan pulse to the row electrodes Xi, Yi, Xi+1, Yi+1, . . . , the number of scan lines (L) of the PDP is twice as large as that of the conventional PDP shown in FIG. 1 and the resolution in the horizontal direction is improved.

The third embodiment of the invention will now be described with reference to FIG. 12.

Figure 12:
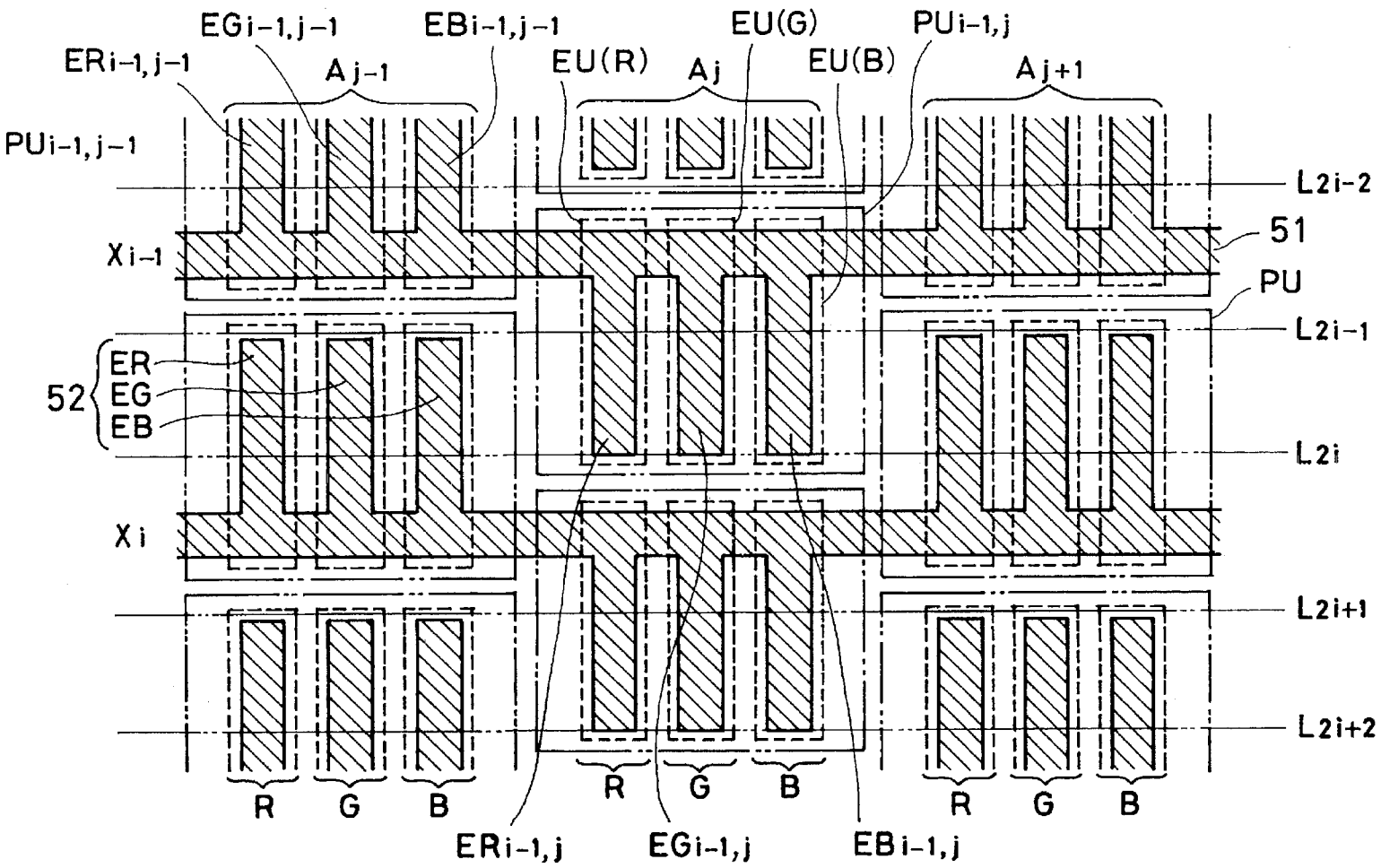
FIG. 12 is a plan view for explaining the relation between each pixel cell and row electrodes in a PDP according to the third embodiment of the invention.

FIG. 12 is a plan view of the pixel cells of a PDP of an A/C facing type. In the pixel cells, the same component elements as those in FIGS. 4 and 5 are designated by the same reference numerals and their descriptions are omitted here.

The row electrodes Xi are formed on the surface of the front substrate 31 which faces the rear substrate 32 by an evaporation deposition of, for example, ITO, SnO (tin oxide), or the like so as to have a film thickness of about a few hundreds nm and to extend in parallel in the horizontal direction. On the other hand, the column electrodes (not shown) which extend in the vertical direction are formed on the rear substrate in a manner similar to FIGS. 4 and 5. The column electrodes are sequentially partitioned in the horizontal direction as a column electrode group Aj in which the three column electrodes which are sequentially arranged in the horizontal direction are set to one unit so as to correspond one pixel cell. Numbers are sequentially added every column electrode group Aj.

The row electrode Xi of the embodiment comprises a main body section 51 which extends in the horizontal direction and a group of electrode members 52 which alternately extend upward and downward in the vertical direction every predetermined distance for the horizontal direction of the main body section 51. One group of electrode members 52 is constructed by three elongated electrode members ER, EG, and EB each having an almost rectangular shape corresponding to the three light emission colors. The fluorescent layers of R, G, and B are formed so as to correspond to the electrode members ER, EG, and EB along the column electrodes. Three discharge spaces are formed by three regions in which the row electrode Xi and three row electrodes of the column electrode group Aj intersect. One unit light emitting region comprising three discharge spaces is formed by setting the pixel cells PU including the fluorescent layers of R, G, and B to one unit. In each discharge space, the discharge is started, maintained, and erased by two electrodes of one row electrode and one column electrode which intersects the row electrode.

That is, when an attention is paid to one row electrode Xi−1, one pixel cell PUi−1,j−1 is formed by three electrode members ERi−1,j−1, EGi−1,j−1, and EBi−1,j−1 extending upward in the vertical direction for the extending direction of the row electrode Xi−1 and the corresponding column electrode group Aj−1. One pixel cell PUi−1,j is formed by three electrode members ERi−1,j, EGi−1,j, and EBi−1,j extending downward in the vertical direction which are formed subsequent to the three electrode members ERi−1, j−1, EGi−1,j−1, and EBi−1,j−1 and the corresponding column electrode group Aj. Therefore, two pixel cells which are neighboring in the horizontal direction are arranged so as to deviate from each other in the vertical direction.

In case of driving the PDP, therefore, when the scan pulse is supplied to the row electrode Xi−1, the pixel data is written into the pixel cells in which the row electrode Xi−1 is used as a component element, namely, PUi−1,j−1, PUi−1,j, and PUi−1,j+1 in FIG. 12. That is, since the writing operation is simultaneously performed to a plurality of pixel cells arranged so as to alternately deviate upward and downward in the vertical direction by setting the row electrode Xi as a center by one scan pulse applied to one row electrode Xi, two horizontal scan lines L2i−2 and L2i−1 are scanned. Namely, the resolution in the vertical direction is improved.

As mentioned above, by using the PDP of the embodiment, the number of scan lines in the vertical direction can be doubled by the same driving method as that of the conventional apparatus and the resolution in the vertical direction can be improved.

The fourth embodiment of the invention will now be described with reference to FIG. 13.

Figure 13:
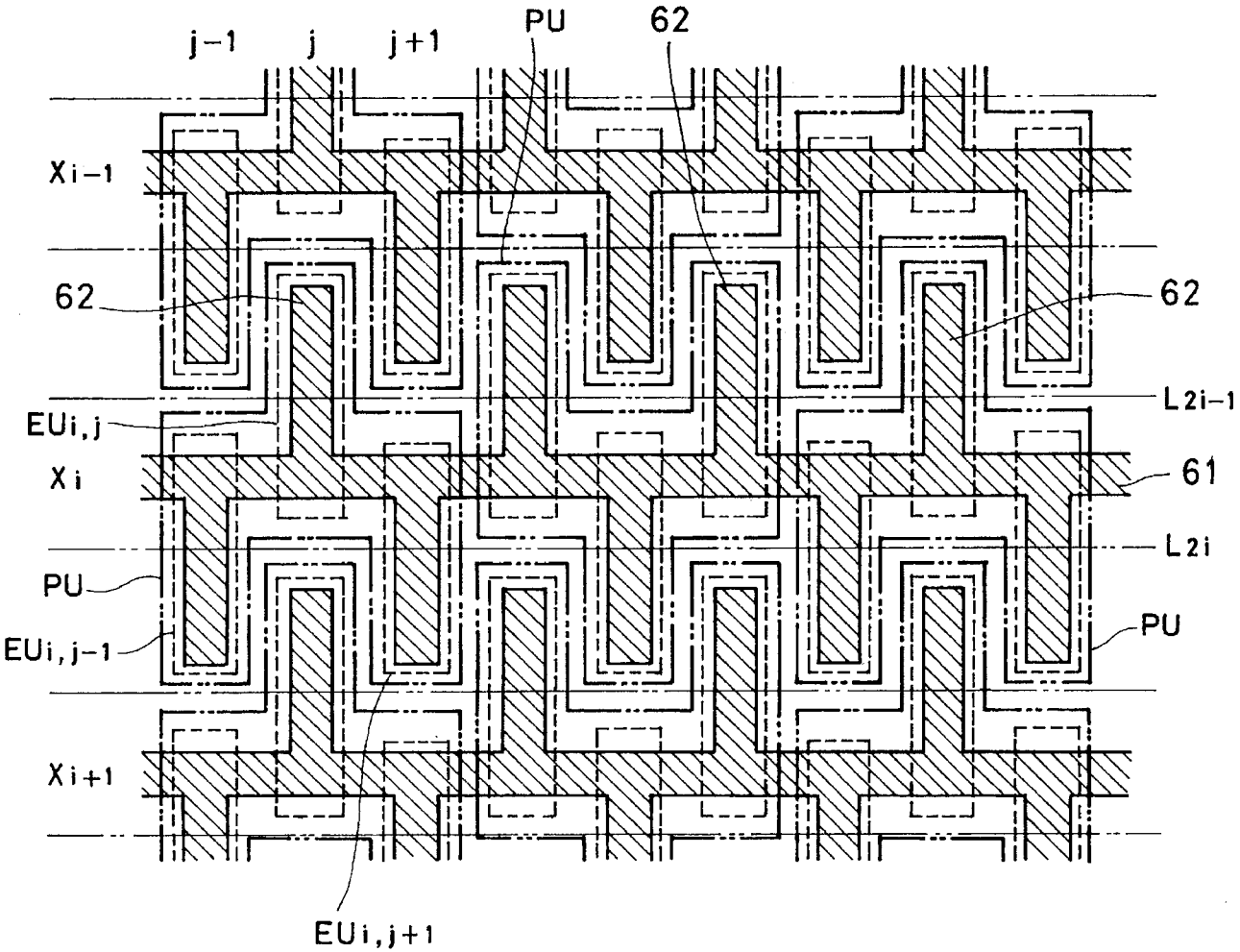
FIG. 13 is a plan view for explaining the relation between each pixel cell and row electrodes in a PDP according to the fourth embodiment of the invention.

FIG. 13 is a plan view of pixel cells of the PDP of the A/C facing type. In the pixel cells, the same component elements as those in FIG. 12 are designated by the same reference numerals and their descriptions are omitted here.

The row electrodes Xi are formed on the surface of the front substrate 31 which faces the rear substrate 32 by an evaporation deposition of, for example, ITO, SnO (tin oxide), or the like so as to have a film thickness of about a few hundreds nm and to extend in parallel in the horizontal direction. On the other hand, the column electrodes (not shown) which extend in the vertical direction are formed on the rear substrate. The fluorescent layers of R, G, and B are formed so that the light emission colors of the adjacent layers are different in accordance with the order of, for example, R, G, and B along the column electrodes.

The row electrode Xi of the embodiment comprises a main body section 61 which extends in the horizontal direction and electrode members 62 which alternately extend upward and downward in the vertical direction every predetermined distance for the horizontal direction of the main body section 61. One electrode member 62 corresponds to one light emission color. The unit light emitting region EU of which light emission color corresponds to one of R, G, and B is formed around the region in which the row electrode Xi and the column electrodes intersect. With such a construction, two light emitting regions which are neighboring in the horizontal direction are arranged so as to deviate each other in the vertical direction. One pixel cell PU is formed by setting three unit light emitting regions EU which are sequentially neighboring in the horizontal direction and have the light emission colors of R, G, and B to one unit.

In case of driving the PDP, therefore, when the scan pulse is applied to the row electrode Xi, the pixel data is written to the unit light emitting regions in which the row electrode Xi is used as a component element, namely, EUi,j−1, EUi,j, EUi,j+1, . . . in FIG. 13. That is, since the writing operation is simultaneously executed by one scan pulse applied to one row electrode Xi to a plurality of unit light emitting regions EU which are alternately arranged so as to deviate upward and downward in the vertical direction by using the row electrode Xi as a center, two horizontal scan lines L2i−1 and L2i can be formed. Thus, the resolution in the vertical direction can be improved.

By using the PDP of the embodiment, therefore, the number of scan lines in the vertical direction can be doubled by the same driving method as that of the conventional apparatus. That is, two scan lines can be formed by one scan pulse which is applied to one row electrode. The resolution in the vertical direction, consequently, can be improved.

The plasma display apparatus of the present invention includes: a plurality of column electrodes which extend in parallel in the vertical direction; light emission layers which are made of fluorescent material films of R (red), G (green), and B (blue) and which extend in parallel along the column electrodes and in which light emission colors of the adjacent layers are different; and a plurality of row electrodes which extend in the horizontal direction perpendicular to the column electrodes and which form unit light emitting regions at positions near the intersecting portions with the column electrodes, wherein among the unit light emitting regions, two regions which are neighboring in the horizontal direction are arranged so as to deviate from each other in the vertical direction, so that the number of scan lines in the vertical direction is twice as large as that of the conventional apparatus, thereby enabling the resolution in the vertical direction to be improved.

What is claimed is:

1. A plasma display apparatus comprising:

a plurality of column electrodes which extend in parallel to each other in a vertical direction;

light emission layers which are made of fluorescent material films of R (red), G (green), and B (blue) and which extend in parallel to each other along said column electrodes and in which colors of emitted light of adjacent layers are different; and a plurality of row electrodes which extend in a horizontal direction perpendicular to said column electrodes and which form unit light emitting regions at positions near their intersecting portions with said column electrodes, each of said row electrodes defining a scanning line, wherein among said unit light emitting regions, two regions which are neighboring in said horizontal direction are arrange so as to deviate from each other in said vertical direction.

2. An apparatus according to claim 1, wherein one of said unit light emitting regions corresponds to three of said column electrodes which sequentially extend in said vertical direction.

3. An apparatus according to claim 1, wherein one of said unit light emitting regions corresponds to one of said column electrodes.

4. A plasma display apparatus comprising:

a plurality of column electrodes which extend in parallel to each other in a vertical direction;

light emission layers which are made of fluorescent material films of R (red), G (green), and B (blue) and which extend in parallel to each other along said column electrodes and in which colors of emitted light of adjacent layers are different; and a plurality of row electrode pairs each of which is constructed by two row electrodes extending in a horizontal direction perpendicular to said vertical direction so as to form a pair and which forms unit light emitting regions ant positions near their intersecting portions with said column electrodes, each of said row electrode pairs defining a scanning line, wherein in one of said unit light emitting regions, the row electrode locating upward among said row electrode pair extends in said horizontal direction and becomes the row electrode locating downward in the unit light emitting region which is neighboring in said horizontal direction and the row electrode locating downward in said row electrode pair extends in said horizontal direction and becomes the row electrode locating upward in the unit light emitting region which is neighboring in said horizontal direction.

5. An apparatus according to claim 4, wherein one of said unit light emitting regions corresponds to three of said column electrodes which sequentially extend in said vertical direction.

6. An apparatus according to claim 4, wherein one of said unit light emitting regions corresponds to one of said column electrodes.

* * * * *